US008613817B2

(12) United States Patent
Hirase et al.

(10) Patent No.: US 8,613,817 B2
(45) Date of Patent: Dec. 24, 2013

(54) METHOD FOR PRODUCING DUPLEX STAINLESS STEEL SEAMLESS PIPE

(75) Inventors: Naoya Hirase, Osaka (JP); Tetsuya Nakanishi, Osaka (JP); Kazuhiro Shimoda, Osaka (JP); Hirokazu Okada, Osaka (JP); Tomio Yamakawa, Osaka (JP); Yasuyoshi Hidaka, Osaka (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 327 days.

(21) Appl. No.: 12/225,545

(22) PCT Filed: Mar. 23, 2007

(86) PCT No.: PCT/JP2007/056020
§ 371 (c)(1),
(2), (4) Date: May 8, 2009

(87) PCT Pub. No.: WO2007/114077
PCT Pub. Date: Oct. 11, 2007

(65) Prior Publication Data

US 2009/0218014 A1 Sep. 3, 2009

(30) Foreign Application Priority Data

Mar. 31, 2006 (JP) ..... 2006-097447

(51) Int. Cl.
*C21D 9/08* (2006.01)
*C21D 9/00* (2006.01)

(52) U.S. Cl.
USPC ..... 148/593; 148/592

(58) Field of Classification Search
USPC ..... 148/593
See application file for complete search history.

(56) References Cited

U.S. PATENT DOCUMENTS 3,540,896 A * 11/1970 Flicker ..... 501/14

FOREIGN PATENT DOCUMENTS

| | | |
|---|---|---|
| JP | 58-224155 | 12/1983 |
| JP | 01-123026 | 5/1989 |
| JP | 4-36421 | 2/1992 |
| JP | 4-165019 | 6/1992 |
| JP | 6-89398 | 11/1994 |
| JP | 9-271811 | 10/1997 |
| JP | 10-251744 | 9/1998 |
| JP | 2005-14032 | 1/2005 |

OTHER PUBLICATIONS

Translation of JP 2005014032.*
Translation of JP 04036421.*

* cited by examiner

*Primary Examiner* — Rebecca Lee
(74) *Attorney, Agent, or Firm* — Clark & Brody

(57) ABSTRACT

The present invention is to provide a method for producing duplex stainless steel seamless pipe in which a duplex stainless steel billet can be inhibited from generating an oxide scale on the surface thereof during heating and the generation of outer surface flaw can also be prevented. The billet is heated in the a heating furnace for 1.5 hours or more and 4.0 hours or less at a heating temperature of 1250° C. or more and 1320° C. or less while regulating the average concentration of sulfur dioxide ($SO_2$) gas in the atmosphere within the furnace to 0.01 volume % or less.

4 Claims, 1 Drawing Sheet

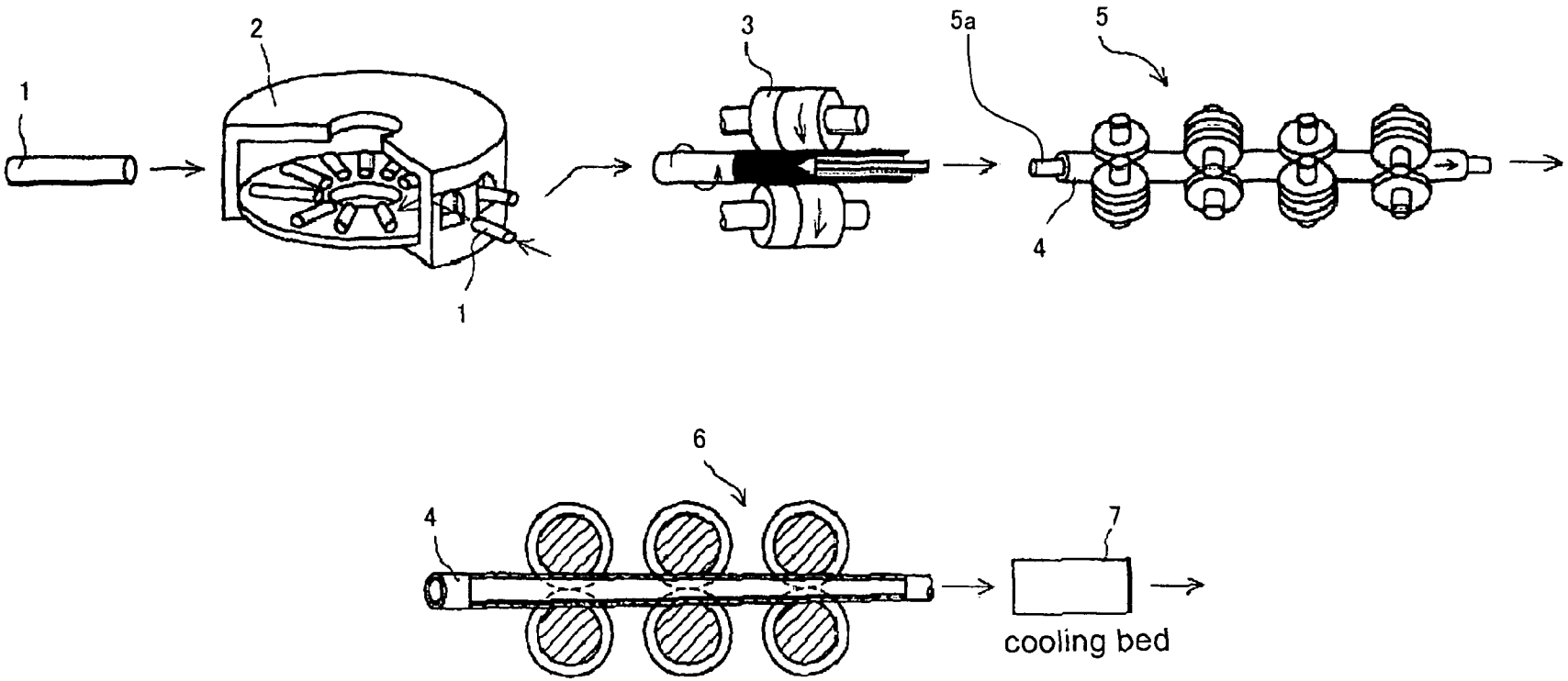
1
2
1
3
5a
5
4
4
6
7
cooling bed

METHOD FOR PRODUCING DUPLEX STAINLESS STEEL SEAMLESS PIPE

TECHNICAL FIELD

The present invention relates to a method for producing a duplex stainless steel seamless pipe or tube (hereinafter, referred to as "pipe"). Particularly, the present invention relates to a method for producing a duplex stainless steel seamless pipe comprising a heating method of billets in the steps of hot metal working, which makes it possible to inhibit generation of surface flaw of the seamless pipes.

BACKGROUND ART

These days, economic scale of economic developing countries including the so-called "BRICS countries" is rapidly expanding. With this circumstance, global energy demand is also rapidly increasing. So, price of crude oil, natural gas, and so on is rising. Rise of the price of crude oil, natural gas, and so on promotes development and mining of deep oil/gas well, and resources having inferior quality such as sour crude, which did not make no business sense in the past. Therefore, demand of oil well tubular and line-pipe (hereinafter, referred to as "seamless pipe" as a generic name.), which is applicable for deep oil well and sour crude and which comprises a material having high-strength and chemical stability like corrosion resistance, is increasing.

In order to produce a seamless pipe comprising a material having high-strength and chemical stability such as corrosion resistance, high-alloy steel such as 18Cr-8Ni stainless steel (Japanese Industrial Standards: SUS 304) and 13Cr, further, duplex stainless steel (DP steel), and the like has become used instead of using conventional materials like carbon steel and chromium-molybdenum steel.

In DP steel at room temperature, a ferrite phase and an austenitic phase are mixed. When temperature varies from high temperature to low temperature, volume of austenitic phase portion increases to the volume of ferrite phase portion within this crystal structure. Since austenitic phase hardly fuses alloy component in a state of solid-solution, austenitic phase tends to deposit in the boundary with ferrite phase, i.e. crystal grain boundary. It is well known that many cracks and flaws are generated at a time of blooming-rolling and piercing-rolling from the deposition in the grain boundary as a point of origin. The flaw caused by deterioration of the high-temperature ductility is generated by micro destruction in the grain boundary between austenitic phase and ferrite phase. This is because, high-temperature strength of austenitic phase is different from that of ferrite phase and also compounds like sulfide which deteriorates hot workability deposits in the grain boundary.

As a method to reduce flaws on the inner and outer surface of a duplex stainless steel seamless pipe, Patent documents 1 and 2 disclose a method to at least regulate heating temperature to be within a certain temperature range where ferrite ratio becomes appropriate (at a ratio of 30 to 70% without W; 40 to 80% with W). According to these documents, by hot metal working within the temperature range, appropriate hot workability of the material is secured and generation of flaws on the material surface is inhibited.

Moreover, as a countermeasure of generation of flaws attributed to the micro destruction in the grain boundary, other than optimizing heating temperature range, these documents propose methods for inhibiting deposition in the grain boundary by reducing P and S, controlling sulfide form of Ca, Mg, and REM, and adding B.

Patent Document 1: Japanese Patent Application Examined No. 6-89398

Patent Document 2: Japanese Patent Application Laid-Open (JP-A) No. 9-271811

DISCLOSURE OF THE INVENTION

Problems to be Solved by the Invention

The inventors had intensively studied; as a result, even if the methods of the above related arts are adopted, when billet of the duplex stainless steel is heated in the heating furnace and amount of oxide scale generation becomes larger on the surface thereof, it was found out that outer flaw is generated more than expected. The reason for this is assumed as follows. The state of oxide scale develops to grain boundary between austenitic phase and ferrite phase. Then, to the grain boundary in which hot workability is usually not good, the developed oxide scale encourages the generation of flaw by the so-called "notch effect".

Accordingly, an object of the present invention is to provide a method for producing duplex stainless steel seamless pipe, the method is capable of inhibiting generation of oxide scale on the surface of a duplex stainless steel billet during its heating to prevent generation of outer flaw of the pipe.

Means for Solving the Problems

Other than temperature, the inventors had discovered the cause of grain boundary oxidation. In other words, if the heating duration of the billet is long in the heating furnace, the grain boundary oxidation increases. Also, the inventors discovered that if sulfur content in the fuel to be burnt in the heating furnace is a large quantity, the grain boundary oxidation is further encouraged.

The present invention has been completed based on the above discoveries of the inventors; the summary of the invention is described as below.

The present invention is a method for producing duplex stainless steel seamless pipe comprising the steps of: heating a billet in a heating furnace; and thereafter, performing hot metal working of said billet, wherein, during the step of heating, the billet is heated in the heating furnace for 1.5 hours or more and 4.0 hours or less at 1250° C. or more and 1320° C. or less while regulating the average concentration of sulfur dioxide ($SO_2$) gas in the atmosphere within the furnace to 0.01 volume % or less.

In the production method, sulfur (S) content in a fuel to be used in the heating furnace during the step of heating is preferably regulated to 0.1 mass % or less.

Moreover, in the production method, a duplex stainless steel for the seamless pipe preferably comprises: a billet containing: in mass %, C, 0.03% or less, Si: 0.1 to 2%, Mn: 0.1 to 2%, P: 0.05% or less, S: 0.008% or less, Al: 0.1% or less, Ni: 5 to 11%, Cr: 17 to 30%, Mo: 1 to 6%, N: 0.1 to 0.4%, Ca: 0 to 0.02%, Mg: 0 to 0.02%, REM: 0 to 0.2%, B: 0 to 0.05%, Cu: 0 to 2%, V: 0 to 1.5%, Ti: 0 to 0.5%, and Nb: 0 to 0.5%; and a residue Fe as well as inevitable impurity.

Here, "REM" means a rare-earth element which is a combination of: scandium group element such as scandium (Sc), yttrium (Y), lanthanum (La), and actinium (Ac); and lanthanum series element being a generic name of fifteen elements from lanthanum to lutetium in the periodic table.

Further, in the production method, the billet as a duplex stainless steel having the above composition preferably further contains, in mass %, over 1.5% and 5% or less of W.

Also, the production method preferably further comprises the step, prior to the step of heating, of: applying, onto the billet's surface, a lubricant composition for hot metal working which contains: an inorganic component as a first component; sodium hydroxide as a second component; water-soluble resins and/or water-soluble surfactants as a third component; and water, wherein the lubricant composition for hot metal working, to a total mass of the first component, the second component, and the third component as 100 mass %, contains: 96.5 mass % or more and 99.98 mass % or less of the first component; 0.01 mass % or more and 0.5 mass % or less of the second component; and 0.01 mass % or more and 1.5 mass % or less of the third component, wherein the inorganic component is one or in combination of two or more selected from the group consisting of: $Al_2O_3$, $SiO_2$, CaO, $B_2O_3$, $K_2O$, and $Na_2O$.

Effects of the Invention

As seen from the description below, according to the method for producing duplex stainless steel seamless pipe of the present invention, generation of flaw attributed to the micro destruction in the grain boundary on the surface of a seamless pipe can be inhibited. Therefore, the quality of the pipe product is improved. Moreover, external grinding needed in the conventional method becomes unnecessary, thus production yield can be improved and productivity can be enhanced.

Such effects and advantages of the inventions will be made apparent from the best mode for carrying out the invention, which will be described as follows.

BRIEF DESCRIPTION OF THE DRAWINGS

FIG. 1 is a schematic view showing a method for producing seamless pipe.

DESCRIPTION OF THE REFERENCE NUMERALS

1 billet
2 heating furnace
3 piercing-rolling mill
4 hollow shell
5 mandrel mill
5*a* mandrel bar
6 sizing mill

BEST MODE FOR CARRYING OUT THE INVENTION

FIG. 1 is a schematic view showing a typical example of method for producing seamless pipe. In FIG. 1, billet 1 is heated in a rotary hearth-type heating furnace 2. The billet 1 heated in the rotary hearth-type heating furnace 2 is taken out from the furnace and then is piercing-rolled by a piercing-rolling mill 3 to produce a hollow shell 4. Then, into the hollow shell 4, a mandrel bar 5*a* is inserted, and the hollow shell is drawing-rolled by a mandrel mill 5 to have a predetermined dimension, thus a crude pipe is produced. Further, the crude pipe is rolled at a fixed-diameter by a sizing mill 6 such as sizer or stretch reducer so as to be a seamless pipe having a predetermined outer diameter. The seamless pipe is cooled in the cooling bed 7 and cut into pieces of predetermined length, then, bend thereof is set straight. Still further, the pipe is tested its quality, marking and the like are given thereto, and finally the pipe is shipped as a finished product.

The present invention is a method for producing duplex stainless steel seamless pipe, the method comprises the steps of: heating a billet in a heating furnace; and thereafter, giving hot metal working to the pipe, wherein during the step of heating, the billet is heated in the heating furnace for 1.5 hours or more and 4.0 hours or less at 1250° C. or more and 1320° C. or less while regulating the average concentration of sulfur dioxide ($SO_2$) gas in the atmosphere within the furnace to 0.01 volume % or less.

Hereinafter, each subject matter of the invention composing the present invention will be described in detail as follows in separate items.

(1) Furnace Average Concentration of Sulfur Dioxide Gas

The method for producing duplex stainless steel seamless pipe of the present invention defines the average concentration of sulfur dioxide ($SO_2$) gas in the atmosphere of heating furnace during the step of heating to be 0.01 volume %. The reason for defining the average concentration of sulfur dioxide ($SO_2$) gas in the atmosphere of heating furnace to be 0.01 volume % or less is because if the $SO_2$ gas concentration in the furnace becomes more than the above, oxidation of the billet surface is encouraged.

About the oxidation encouraging mechanism, the inventors assume as follows. Namely, when sulfur content in the fuel is high, and average concentration of sulfur dioxide ($SO_2$) gas in the atmosphere of the furnace becomes 0.01% or more, $SO_2$ infiltrated into the oxidized portion on the billet surface forms low-melting sulfide together with components of Ni or the like existing in the steel. It should be noted that melting point of NiS as a sulfide of Ni is 996° C., melting point of $MOS_3$ as a sulfide of Mo is 1185° C., melting point of FeS as a sulfide of Fe is 1195° C.; these in the heating furnace are assumed to be in a molten state. Hence, a liquid phase, which can disperse oxygen much more rapidly than solid phase dose, is formed in the oxide scale, oxidation is promoted in the grain boundary between the austenitic phase and the ferrite phase of the duplex stainless steel. Consequently, outer flaw which has been produced from the grain boundary, as a point of origin, between austenitic phase and ferrite phase seemingly encourages the flaws itself to become larger.

In order to set the average concentration of sulfur dioxide ($SO_2$) gas in the atmosphere of the heating furnace to 0.01 volume % or less, sulfur content in the fuel supplied to the heating furnace has to be considered before using.

Examples of fuel for the heating furnace include: a fuel oil obtained by fractional distillation of crude oil such as heavy fuel oil, gas oil, kerosene, naphtha, and LPG such as butane/propane; crude oil itself; natural gas; city gas; and C-gas (coke-oven gas) generated in the steelworks. Among them, naphtha, LPG such as butane/propane, natural gas, city gas, and C-gas generated in the steelworks and the like have small sulfur content and these are suitably used as a fuel for the heating furnace in the method for producing duplex stainless steel seamless pipe of the invention; whereby the average concentration of sulfur dioxide ($SO_2$) gas in the atmosphere of the furnace can be easily adjusted to 0.01 volume % or less.

Among the fuel oil obtained by fractional distillation of crude oil, kerosene, gas oil, and heavy fuel oil, in general, contain about 0.01 to 3.0 mass % of sulfur content. When these fuels are used, particularly, sulfur content has to be considered before using. According to the inventors' experience, in case where the sulfur content in the fuel is 0.1 mass %, it is possible to adjust the $SO_2$ concentration in the heating atmosphere to about 0.01 volume %. Therefore, when any one of these kerosene, gas oil, and heavy fuel oil are used, one of which sulfur content is 0.1 mass % or less should be selected and used. It should be noted that low-sulfur crude oil produced in Minas and Daqing can be used with no distillation; however, this case still needs to adjust the sulfur content in the crude oil to 0.1 mass % or less.

The inventors of the invention selected the fuels for heating furnace as follows:

(a) in case of using heavy fuel oil C having 1.2 mass % of sulfur content (measurement of average $SO_2$ concentration in the furnace is 0.08 volume %);

(b) in case of using super-low-sulfur heavy fuel oil C having 0.02 mass % of sulfur content (measurement of average $SO_2$ concentration in the furnace is 0.003 volume % or less); and (c) in case of using C-gas which does not substantially contain sulfur (measurement of average $SO_2$ concentration in the furnace is substantially 0.0 volume %), and carried out heating of each sample of the duplex stainless steel in the furnace at 1300° C. for 3 hours; then, cross section of each sample in the depth direction of surface oxidized layer was microscopically observed. As a result, by minimizing sulfur content contained in the fuel to be used in the surface, it has been observed that scale-like flaws generated on the surface of duplex stainless steel can be inhibited.

(2) Heating Temperature and Heating Duration in the Furnace

In order to clarify the cause which encourages the flaw (hereinafter, refer to as "scale-like flaw".) produced across the entire surface of the material, the inventors investigated N (nitrogen) and B (boron) contents in the depth direction from the surface layer of the samples of duplex stainless steel when temperature and holding time of which in the furnace are varied.

According to the research related to N, the samples tested under high furnace temperature and long furnace holding time show that N portion near the surface layer exhibits higher than ladle analysis values. In addition, according to the research related to B, each sample shows reduction of B content in vicinity of the surface layer from ladle analysis values. Particularly, about the samples tested under high furnace temperature and long furnace holding time, reduction of B content was observed down to the depth of about 1.5 mm from the surface layer. As a result, cause of generation of the scale-like flaw is assumed to be the nitriding in the vicinity of the outer surface and the deboronation by heating billet. In other words, $B_2O_3$ as an oxide of B is more stable than $Cr_2O_3$ as an oxide of Cr, and has a same level of stability with $SiO_2$ as an oxide of Si; B is preferentially-oxidized at the same time of high-temperature heating thereby B-deficient layer is produced. B is quickly dispersed so that the deficient layer expands up to the mm order. Due to the loss of B originally segregated in the grain boundary, S becomes able to segregate at the grain boundary, and grain boundary embrittles. On the other hand, at the beginning of heating, $Cr_2O_3$ coating is formed and that becomes a barrier; although N in the atmosphere cannot easily penetrate the steel, once the coating is destroyed by heating at a temperature over 1200° C., nitriding becomes possible and N is fused in a state of solid-solution in austenite, whereby strength difference to ferrite becomes widened. Hence, together with the embrittleness of the grain boundary by deboronation, workability becomes deteriorated and that eventually encourages the generation of scale-like flaw.

2-1. Furnace Heating Duration

The method for producing the duplex stainless steel seamless pipe of the present invention is carried out by setting the furnace heating duration about a billet to 1.5 hours or more and 4.0 hours or less. The upper limit of the heating duration is preferably 3.0 hours.

When the heating duration is less than 1.5 hours, the billet cannot be sufficiently heated; such a billet shows high deformation resistance, and e.g., defect by drawing-rolling is caused in the step of hot metal working after heating. In addition, the above heating duration may give uneven temperature across the billet, the billet is rolled while keeping the temperature difference therein; defect in uneven thickness, for instance, is caused to the crude pipe in the step of hot metal working after heating.

Meanwhile, when the heating duration exceeds 4.0 hours, grain boundary oxidation is facilitated, thereby generation of outer flaw is encouraged.

2-2. Furnace Heating Temperature

The method for producing the duplex stainless steel seamless pipe of the invention is carried out by setting the furnace heating temperature about a billet to 1250° C. or more and 1320° C. or less. The upper limit of the heating temperature is preferably 1290° C.

When the heating temperature is less than 1250° C., as shown in the above-mentioned Patent documents 1 and 2, ferrite content does not reach 40 to 80 volume %, phase balance of the billet is way off. Thereby, hot workability is inadequate, and scale-like flaw is generated.

On the other hand, when heating temperature exceeds 1320° C., ratio of ferrite phase becomes higher, which raise the temperature over the solidus temperature of the material; hence, flow and outer wrinkle by grain boundary fusion are caused. Further, grain boundary oxidation is facilitated and that encourages the generation of outer flaw.

Still further, when the heating temperature and heating duration are over the upper limit, B, which works to inhibit the deterioration of hot workability, in the steel at the vicinity of billet's surface decreases; segregation of S in the grain boundary is facilitated, which deteriorates the hot workability. Still further, when N in the heating atmosphere infiltrates steel at the vicinity of the billet surface, strength of the austenitic phase increases; and strength difference of grain boundary between the austenitic phase and the ferrite phase is widened, which encourages flaws generating from the grain boundary.

(3) Billet

Materials of the billets to be used in the method for producing the duplex stainless steel seamless pipe of the invention is not restricted to, as long as it is the one normally called "duplex stainless steel". The billet to be used in the invention is preferably a duplex stainless steel which contains: C, 0.03% or less, Si: 0.1 to 2%, Mn: 0.1 to 2%, P: 0.05% or less, S: 0.008% or less, Al: 0.1% or less, Ni: 5 to 11%, Cr: 17 to 30%, Mo: 1 to 6%, N, 0.1 to 0.4%, Ca: 0 to 0.02%, Mg: 0 to 0.02%, REM: 0 to 0.2%, B: 0 to 0.05%, Cu: 0 to 2%, V: 0 to 1.5%, Ti: 0 to 0.5%, and Nb: 0 to 0.5% (in mass %); and residue Fe as well as inevitable impurity.

Moreover, the above duplex stainless steel preferably contains more than 1.5% and 5% or less in mass % of W.

The reason why the duplex stainless steel containing the above individual components and the certain content are preferable will be described as below.

C, same as N below, is effective for stabilize austenitic phase. However, when the content thereof is over 0.03%, carbide tends to separate out; thereby corrosion resistance of the steel becomes deteriorated.

Si is effective as a deoxidant; however, if the content is less than 0.1%, the effect cannot be obtained. On the other hand, when the content is over 2%, brittle σ-phase tends to separate out so that the toughness of the steel is deteriorated.

Mn is effective as a deoxidant and a desulfurization agent, but also contributes to improve stability of austenitic phase and hot workability. However, if the content is less than 0.1%, the effect cannot be obtained. On the other hand, when the content is over 2%, corrosion resistance of the steel becomes deteriorated.

P is an impurity element which inevitably mixed into the steel. When the content is over 0.05%, corrosion resistance and toughness of the steel are seriously deteriorated.

S, same as the abovementioned P, is an impurity element which inevitably mixed into the steel, and this seriously deteriorates the steel's hot workability. In addition, the sulfide thereof becomes a point of origin of pitting corrosion to deteriorate corrosion resistance of the steel. Therefore, content of S is preferably as small as possible; if it is 0.008% or less, it causes substantially no problem, still desirably 0.0005% or less.

Al is effective as a deoxidant. However, as described below, in the high-N and high-W duplex stainless steel into which a large amount of N is added to improve corrosion resistance, when a large amount of Al is added to, a massive amount of AlN separates out; hence toughness and corrosion resistance are deteriorated. Therefore, the content is preferably as small as possible, 0.1% or less of Al content will cause substantially no problem.

Ni is an austenitic phase forming element and contributes to inhibit deposition of δ-ferrite phase. However, when the content is less than 5%, amount of ferrite becomes excessive so that features of the duplex stainless steel disappear. Further, N's solid solubility in ferrite is small, nitride tends to separate out and corrosion resistance of the steel is deteriorated. Meanwhile, when the content is over 11%, the amount of ferrite becomes excessive, features of the duplex stainless steel disappear and brittle σ-phase tends to separate out; thereby toughness of the steel is deteriorated.

Cr is an essential component to secure corrosion resistance of the steel. When the content is less than 17%, essential corrosion resistance cannot be secured. On the other hand, the content is over 30%, brittle σ-phase tends to separate out, not only corrosion resistance but also hot workability and weldability of the steel are deteriorated.

Mo, same as Cr, is effective to improve corrosion resistance, particularly, pitting corrosion resistance and gap corrosion resistance. However, when the content is less than 1%, the effect cannot be obtained. On the other hand, when the content exceeds 6%, brittle σ-phase tends to separate out, which deteriorates the hot workability.

W is an optional additive element. W is, different from Mo, effective to improve corrosion resistance, particularly pitting corrosion resistance and gap corrosion resistance without facilitating production of intermetallics like σ-phase, so that it is an element which is capable of securing high corrosion resistance without increasing the contents of the above Cr and Mo as well as below-described N. In order to obtain the effect, the content should preferably be over 1.5%. Meanwhile, as W is expensive, containing excessive amount of W drives increase of material cost whereby the steel loses its economic efficiency but also lowers melting point of the steel (solidus temperature) to lower the high-temperature ductility. Further, even if over 5% of W is contained, the effect to improve corrosion resistance becomes saturated; thus, the upper limit should preferably be 5%.

N is an austenitic phase forming element, and it is effective to improve thermal stability and corrosion resistance of steel containing relatively large amount of ferrite-phase-forming element such as Cr, Mo, and W. However, when the content is less than 0.1%, these effects cannot be obtained. On the other hand, when the content exceeds 0.4%, melting point (solidus temperature) of the steel becomes lowered, so high-temperature ductility at a high-temperature side of the pipe becomes lowered, and blowhole is produced at the welded part, but also a large amount of nitride is produced at a time of butt-welding for connecting finished pipe products; whereby toughness and corrosion resistance at the welded part is deteriorated.

About Ca, Mg, REM (La, Ce, Y, etc.) and B, each of these elements is capable of inhibiting segregation, in the crystal grain boundary, of S which is inevitably contained as an impurity in the steel, so as to improve workability of the steel. These are elements particularly effective to inhibit deterioration of hot workability of outer surface layer of the billet caused by decline of temperature during hot working. In other words, Ca, Mg, and REM fix S and O (oxygen) solidly dispersed in the steel as the sulfide and oxide thereof and inhibit segregation of S and O in crystal grain boundary to improve hot process. Meanwhile, B, as the size of atom is larger than that of S and O, preferentially segregates in the crystal grain boundary and inhibits segregation of S and O in the crystal grain boundary to improve hot workability. Thus, in order to improve the hot workability further more, one or more of these elements are preferably added to the steel.

Nevertheless, when the contents of respective Ca, Mg, and REM are less than 0.0005% and the content of B is less than 0.0001%, the above-described effects cannot be obtained. On the other hand, if the contents of individual Ca and Mg are over 0.02%, the content of REM is over 0.2%, and the content is over 0.05%, corrosion resistance of the steel is deteriorated.

Namely, containing large amount of Ca, Mg, and REM overwhelming the above upper limit results in a production of large amount of sulfide and oxide in the steel, since sulfide and oxide become the origin of pitting corrosion thereby deteriorates corrosion resistance of the steel. Moreover, when containing excessive amount of B which overwhelms the above upper limit results in the production of nitride and carbide of B in the steel, which deteriorates toughness of the steel.

Accordingly, when these elements are added, the contents of respective Ca and Mg is preferably 0.0005 to 0.02%, the content of REM is preferably 0.0005 to 0.2%, and the content of B is preferably 0.0001 to 0.05%.

Elements: Cu, V, Ti, and Nb respectively have an effect to improve corrosion resistance of the steel. Among these, especially, Cu has an effect to further improve corrosion resistance under reducing low pH condition, i.e. the condition containing a large amount of sulfuric acid and hydrogen sulfide. Also, V, which is contained in a composite addition with W, has an effect to further improve gap corrosion resistance. Hence, when these effects are demanded, one or more of the above elements can be added.

However, when the contents of: Cu is less than 0.1%, V is less than 0.05%, Ti and Nb respectively are less than 0.01%, the above effects cannot be obtained. On the other hand, when the content of Cu is over 2%, hot workability of the steel declines. Also, when the content of V is over 1.5%, amount of ferrite increases, by contraries, not only corrosion resistance but also toughness of the steel are lowered. Further, about Ti and Nb, when the contents thereof exceed 0.5%, toughness of the steel declines.

Therefore, when these elements are added, the content of Cu is preferably 0.1 to 2%, the content of V is preferably 0.05 to 1.5%, and the content of Ti and Nb respectively are preferably 0.01 to 0.5%.

(4) Uses of Lubricant Composition for Hot Metal Working

In the production method of the present invention, prior to the heating step, it is preferable to provide the step for applying, onto the billet's surface, lubricant composition for hot metal working which contains an inorganic component as a first component, sodium hydroxide as a second component, water-soluble resins and/or water-soluble surfactants as a third component, and water. Because, inhibition of grain boundary oxidation by the composition is effective. The lubricant composition for hot metal working, to a total mass of the first component, the second component, and the third component as 100 mass %, contains: 96.5 mass % or more and 99.98 mass % or less of the first component; 0.01 mass % or more and 0.5 mass % or less of the second component; and 0.01 mass % or more and 1.5 mass % or less of the third component, wherein the inorganic component is one or more selected from the group consisting of: $Al_2O_3$, $SiO_2$, CaO, $B_2O_3$, $K_2O$, and $Na_2O$. Hereinafter, outline of the lubricant composition for hot metal working of the present invention will be described below.

The inorganic component as the first component of the lubricant composition for hot metal working is a mixture of a ceramic base material and an inorganic binder. The phrase "ceramic base material" means a base material containing aluminum oxide or silicon oxide, or a mixture thereof. Moreover, the ceramic base material is to become a main component, after drying, of the coating layer to be formed on the surface of processed material and it exhibits an effect to secure thermal resistance of the coating layer. Content of the first component, to a total mass of the first component, the second component, and the third component as 100 mass %, is preferably 96.5 mass % or more and 99.98 mass % or less.

The second component of the lubricant composition for hot metal working is sodium hydroxide. In hot working, sodium hydroxide reacts as sodium oxide with silicon oxide, particularly silicon oxide in the first component at high temperature and gradually becomes sodium silicate. So, the behavior of the second component at high temperature is same as that of liquid glass; hence, it works as an adhesive at high temperature in the heating before hot metal working. Further, compared with liquid glass, as water contained in the second component evaporates easily and independently, the second component has an advantage of non-foamability.

The second component is mixed at a ratio of 0.01 mass % or more and 0.5 mass % or less, to a total mass of the first component, the second component, and the third component as 100 mass %. With the proviso that if content of sodium hydroxide is excessive, excessive amount of sodium component may cause high-temperature alkali corrosion to the surface of the steel. In addition, high-alkali condition makes the handling of the composition difficult, whereby workability is deteriorated.

Still further, in the lubricant composition for hot metal working, as the third component, water-soluble resins and a water-soluble surfactant may be added, as required. The water-soluble resins act as an adhesive and a spreading agent when the composition is applied on the surface of processed material at room temperature. After drying, the water-soluble resins contribute to improve elasticity of the coating layer and to inhibit cracking of the coating layer. The water-soluble surfactant imparts wettability and dispersion to the first component as an inorganic component, and improves lubricity at a time of application at room temperature. The water-soluble surfactant also improves homogeneous coating property and surface smoothness when the lubricant composition for hot metal working is applied; it also prevents cracking of coating layer.

EXAMPLES (Billet)

Duplex stainless steel billets having an outer diameter of 225 mm were used. The alloy composition thereof (in mass %) comprises: C, 0.011%, Si: 0.28%, Mn: 0.47%, P: 0.018%, S: 0.002%, Al: 0.02%, Ni: 7.05%, Cr: 25.01%, Mo: 3.48%, W: 1.63%, N: 0.241%, Ca: 0.0042%, Mg: 0.0001%, REM: 0.0001, B: 0%, Cu: 0.02%, V: 0.01%, and residue Fe as well as inevitable impurity.

(Application of the Lubricant Composition for Hot Metal Working)

To the surface of a billet, the lubricant composition for hot metal working is applied, in advance. As NaOH for the composition, two types of NaOH, i.e. NaOH having concentration of 0.2 mass % and of 2 mass % in the composition, were provided. For comparison, billets, to which the lubricant composition was not applied, were prepared.

(Heating Furnace Condition)

Heating furnace condition was varied within the range as below.

Heating temperature: 1240 to 1330° C.

Heating duration: 1.0 to 4.5 hours

Sulfur content (mass %) in the fuel for heating furnace: 0 to 1.00

Average $SO_2$ concentration (volume %) under atmosphere of heating furnace: 0 to 0.1

(Method for Producing Seamless Pipe)

A billet was taken out from the above furnace and worked by using stretching mill such as piercing-rolling mill and mandrel mill as well as sizing mill such as sizer to obtain a seamless pipe having the product dimension in 190 mm in diameter and pipe wall thickness in 11.5 to 15.0 mm. It should be noted that between the cases where $SO_2$ content under heating atmosphere is zero and other than it, pipe production lines are different, and tools for piercing mill are also different. However, piercing ratio of both cases are respectively 2.3 to 2.5 so that tendency of surface flaw of the product is almost the same from each other.

(Evaluation)

The finished products obtained in accordance with the above procedures were visually observed about the outer flaw. Evaluation results were recorded based on the following criteria. The results are shown in Table 1.

<Evaluation Criteria>

◎: excellent

○: good

Δ: average x: unsatisfactory

TABLE 1

| Heating temperature (° C.) | Heating duration (hour) | Average $SO_2$ concentration in the furnace (volume %) | Application of lubricant composition for hot metal working | Comprehensive evaluation |
|---|---|---|---|---|
| 1240 | 3.0 | 0 | None | X |
| 1275 | 3.0 | 0 | None | Δ |
| 1285 | 1.0 | 0 | None | X |
| 1285 | 2.0 | 0 | None | ◎ |
| 1285 | 3.0 | 0 | None | ◎ |
| 1285 | 4.0 | 0 | None | ○ |
| 1285 | 4.5 | 0 | None | X |
| 1285 | 4.0 | 0 | Applied (NaOH = solid 0.2%) | ◎ |

TABLE 1-continued

| Heating temperature (° C.) | Heating duration (hour) | Average $SO_2$ concentration in the furnace (volume %) | Application of lubricant composition for hot metal working | Comprehensive evaluation |
|---|---|---|---|---|
| 1285 | 4.0 | 0 | Applied (NaOH = solid 2%) | Δ |
| 1300 | 2.0 | 0 | None | ○ |
| 1300 | 4.0 | 0 | None | Δ |
| 1330 | 2.0 | 0 | None | X |
| 1280 | 3.0 | 0.01 | None | Δ |
| 1280 | 3.0 | 0.01 | Applied (NaOH = solid 0.2%) | ○ |
| 1280 | 4.0 | 0.001 | None | ○ |
| 1280 | 4.0 | 0.001 | Applied (NaOH = solid 0.2%) | ◎ |
| 1280 | 4.0 | 0.10 | None | X |
| 1280 | 2.0 | 0.10 | None | X |

(Evaluation Results)

As shown in Table 1, the seamless pipe produced by keeping the range of heating temperature, heating duration, and average $SO_2$ concentration in the furnace, those of which are determined in the present invention, had low degree of flaw generation on the surface of finished product.

The above has described the present invention associated with the most practical and preferred embodiments thereof. However, the invention is not limited to the embodiments disclosed in the specification. Thus, the invention can be appropriately varied as long as the variation is not contrary to the subject substance and conception of the invention which can be read out from the claims and the whole contents of the specification. It should be understood that the method for producing duplex stainless steel seamless pipe with such an alternation are included in the technical scope of the invention.

The invention claimed is:

1. A method for producing duplex stainless steel seamless pipe, the method comprising the steps of:

applying, onto a billet's surface, a lubricant composition for hot metal working consisting of an inorganic component as a first component; sodium hydroxide as a second component; water-soluble resins and/or water-soluble surfactants as a third component; and water, wherein said lubricant composition for hot metal working, to a total mass of said first component, said second component, and said third component as 100 mass %, consists of: 96.5 mass % or more and 99.98 mass % or less of said first component; 0.01 mass % or more and 0.5 mass % or less of said second component; and 0.01 mass % or more and 1.5 mass % or less of said third component, wherein said inorganic component is one or in combination of two or more selected from the group consisting of: $Al_2O_3$, $SiO_2$, CaO, $B_2O_3$, $K_2O$, and $Na_2O$;

heating the billet in a heating furnace after the step of applying the lubricant composition, wherein, during the step of heating, said billet is heated in the heating furnace for 1.5 hours or more and 4.0 hours or less at 1250° C. or more and 1320° C. or less while regulating the average concentration of sulfur dioxide ($SO_2$) gas in the atmosphere within the furnace to 0.01 volume % or less, and performing hot metal working of said billet after the step of heating.

2. The method for producing duplex stainless steel seamless pipe according to claim 1, wherein sulfur (S) content in a fuel to be used in said heating furnace in the step of heating is regulated to 0.1 mass % or less.

3. The method for producing duplex stainless steel seamless pipe according to claim 1, wherein a duplex stainless steel for said seamless pipe comprising said billet contains: in mass %, C: 0.03% or less,
Si: 0.1 to 2%,
Mn: 0.1 to 2%,
P: 0.05% or less,
S: 0.008% or less,
Al: 0.1% or less,
Ni: 5 to 11%,
Cr: 17 to 30%,
Mo: 1 to 6%,
N: 0.1 to 0.4%,
Ca: 0 to 0.02%,
Mg: 0 to 0.02%,
REM: 0 to 0.2%,
B: 0 to 0.05%,
Cu: 0 to 2%,
V: 0 to 1.5%,
Ti: 0 to 0.5%, and
Nb: 0 to 0.5%, and
a residue Fe as well as inevitable impurity.

4. The method for producing duplex stainless steel seamless pipe according to claim 1, wherein said billet further contains, in mass %, over 1.5% and 5% or less of W.

* * * * *

UNITED STATES PATENT AND TRADEMARK OFFICE

CERTIFICATE OF CORRECTION

PATENT NO. : 8,613,817 B2
APPLICATION NO. : 12/225545
DATED : December 24, 2013
INVENTOR(S) : Hirase et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 761 days.

Signed and Sealed this
Twenty-second Day of September, 2015

Michelle K. Lee

Michelle K. Lee
*Director of the United States Patent and Trademark Office*